US010048630B2

(12) United States Patent
Buthrath

(10) Patent No.: US 10,048,630 B2
(45) Date of Patent: Aug. 14, 2018

(54) PRINTER

(71) Applicant: SATO HOLDINGS KABUSHIKI KAISHA, Tokyo (JP)

(72) Inventor: Nuttawuth Buthrath, Tokyo (JP)

(73) Assignee: SATO HOLDINGS KABUSHIKI KAISHA, Tokyo (JP)

( * ) Notice: Subject to any disclaimer, the term of this patent is extended or adjusted under 35 U.S.C. 154(b) by 0 days.

(21) Appl. No.: 15/510,084

(22) PCT Filed: Apr. 8, 2015

(86) PCT No.: PCT/JP2015/060953
§ 371 (c)(1),
(2) Date: Mar. 9, 2017

(87) PCT Pub. No.: WO2016/121138
PCT Pub. Date: Aug. 4, 2016

(65) Prior Publication Data

US 2017/0308013 A1 Oct. 26, 2017

(30) Foreign Application Priority Data

Jan. 30, 2015 (JP) ..... 2015-016810

(51) Int. Cl.
*G03G 15/00* (2006.01)

(52) U.S. Cl.
CPC ..... *G03G 15/5029* (2013.01)

(58) Field of Classification Search
CPC ..... B41J 3/36; B41J 15/04; B41J 29/00; B41J 29/13; B41J 2/32; B41J 3/4075;
(Continued)

(56) References Cited

U.S. PATENT DOCUMENTS 8,702,329 B2 * 4/2014 Takabatake ..... B41J 3/4075 400/611
9,052,659 B2 6/2015 Yanata
(Continued)

FOREIGN PATENT DOCUMENTS

JP 6-156463 A 6/1994
JP 9-249339 A 9/1997
(Continued)

*Primary Examiner* — David Banh
(74) *Attorney, Agent, or Firm* — Foley & Lardner LLP

(57) ABSTRACT

A printer includes: a first roller feeding a liner; a print unit printing information on a print medium temporarily adhering to the liner fed by the first roller; a second roller located at a first position when performing a print operation in a first print mode, and a second position when performing the print operation in a second print mode, at which second position the second roller rotates by the rotation of the first roller to separate the print medium from the liner; a reflective optical sensor including a light emitting part and a light receiving part arranged in an upward and downward direction defined when the printer is placed on a horizontal surface, and that is used to determine a position of the second roller; and a sensor housing containing the light receiving part. The sensor housing has a surface opposite to the light receiving part. The surface has an opening on a side of the light emitting part, and a light blocking part on a side opposite to the side of the light emitting part.

21 Claims, 13 Drawing Sheets

(58) Field of Classification Search
CPC .. B41J 13/03; B41J 29/02; B65C 9/18; G03G 15/5029
See application file for complete search history.

(56) References Cited

U.S. PATENT DOCUMENTS

| | | | | |
|---|---|---|---|---|
| 2006/0151118 | A1 | 7/2006 | Murata et al. | |
| 2011/0133391 | A1* | 6/2011 | Akiyama | B65H 1/14 271/110 |
| 2013/0164007 | A1 | 6/2013 | Yanata | |
| 2017/0021649 | A1* | 1/2017 | Hirose | B41J 3/36 |
| 2017/0036462 | A1* | 2/2017 | Katayama | B41J 3/36 |
| 2017/0036469 | A1* | 2/2017 | Katayama | B41J 2/32 |

FOREIGN PATENT DOCUMENTS

| | | | |
|---|---|---|---|
| JP | 11-11759 | A | 1/1999 |
| JP | 2006-150857 | A | 6/2006 |
| JP | 2007-185774 | A | 7/2007 |
| JP | 2013-135118 | A | 7/2013 |

* cited by examiner

PRINTER

FIELD

The present invention relates to a printer that prints information on a print medium temporarily adhering to a liner.

BACKGROUND

A label printer uses a continuous label including a band-like liner and a plurality of labels temporarily adhering to the liner, and prints information on each label as follows: it causes a thermal head and a platen roller to pinch one edge of the continuous label, rotates a platen roller to extract and feed the continuous label in a sheet shape, and prints information on each label while the sheet-like form is extracted and fed.

Some label printers have two print modes (i.e. continuous-print mode and separation print mode) for their operation (for example, Laid open patent publication JP 2006-150857 A). The continuous-print mode is a mode to continuously print information on two or more labels. The separation print mode is a mode to separate each label from the liner every time information is printed on each label. Such label printers include an optical sensor used for determination of a print mode, and a determination part configured to determine the print mode based on the intensity of light detected by the optical sensor.

BRIEF SUMMARY

Technical Problem

The conventional label printers, however, may cause disturbance light to enter the sensor. When the sensor detects the disturbance light, the determination part can erroneously determine a print mode.

The present invention has been made in view of the above situation. An object of the present invention is to prevent erroneous determination of print modes.

Solution to Problem

According to a first aspect of the present invention, it is provided a printer configured to perform a print operation in at least one of a first print mode in which information is printed on a print medium temporarily adhering to a liner and then the print medium is not separated from the liner, or a second print mode in which information is printed on the print medium and then the print medium is separated from the liner, the printer comprising:

a first roller configured to feed the liner;

a print unit configured to print information on the print medium temporarily adhering to the liner fed by the first roller;

a second roller located at a first position when performing the print operation in the first print mode, and located at a second position when performing the print operation in the second print mode, at which second position the second roller rotates by the rotation of the first roller to separate the print medium from the liner;

a reflective optical sensor including a light emitting part and a light receiving part that are arranged in a direction of a sheet-feeding path, the reflective optical sensor configured to determine a position of the second roller; and a sensor housing configured to house the light receiving part, the sensor housing having a surface adjacent to the light receiving part, the surface having an opening on a side of the light emitting part and a light blocking part on a side opposite to the side of the light emitting part.

According to a second aspect of the present invention, it is provided a printer configured to perform a print operation in at least one of a first print mode in which information is printed on a print medium temporarily adhering to a liner and then the print medium is not separated from the liner, or a second print mode in which information is printed on the print medium and then the print medium is separated from the liner, the printer comprising:

a first roller configured to feed the liner;

a print unit configured to print information on the print medium temporarily adhering to the liner fed by the first roller;

a second roller located at a first position when performing the print operation in the first print mode, and located at a second position when performing the print operation in the second print mode to separate the print medium from the liner by splitting a sheet-feeding path of the print medium from a sheet-feeding path of the liner;

a reflective optical sensor including a light emitting part and a light receiving part that are arranged in a direction of the sheet-feeding path, the reflective optical sensor configured to determine a position of the second roller; and a sensor housing configured to house the light receiving part, the sensor housing having a surface adjacent to the light receiving part, the surface having an opening on a side of the light emitting part and a light blocking part on a side opposite to the side of the light emitting part.

According to a third aspect of the present invention, the first position may be a position at which the second roller blocks light from entering through the opening.

According to a forth aspect of the present invention, the light receiving part may be disposed on a downstream side of the sheet-feeding path with respect to the light emitting part.

According to a fifth aspect of the present invention, the printer may further comprise a first determination part configured to compare intensity of light received by the light receiving part with a first threshold to determine the print mode.

According to a sixth aspect of the present invention, the first determination part may determine the print mode when printing by the print unit is enabled.

According to a seventh aspect of the present invention, the first determination part may determine the print mode when the printer is powered on.

According to an eighth aspect of the present invention, the printer may further comprise a second determination part configured to compare, when performing the print operation in the second print mode, intensity of light received by the light receiving part with a second threshold larger than the first threshold to determine whether there is the print medium separated from the liner.

According to a ninth aspect of the present invention, it is provided a printer configured to perform a print operation in at least one of a first print mode in which information is printed on a print medium temporarily adhering to a liner and then the print medium is not separated from the liner, or a second print mode in which information is printed on the print medium and then the print medium is separated from the liner, the printer comprising:

a first roller configured to feed the liner;

a print unit configured to print information on the print medium temporarily adhering to the liner fed by the first roller;

a second roller located at a first position when performing the print operation in the first print mode, and located at a second position when performing the print operation in the second print mode to separate the print medium from the liner;

an optical sensor configured to determine a position of the second roller;

a first determination part configured to compare intensity of light received by the light receiving part with a first threshold to determine the print mode; and a second determination part configured to compare, when performing the print operation in the second print mode, intensity of light received by the light receiving part with a second threshold larger than the first threshold to determine whether there is a print medium separated from the liner, wherein the first position is a position at which the second roller blocks light from entering through the opening.

According to a tenth aspect of the present invention, the first determination part may determine the print mode when printing by the print unit is enabled.

According to an eleventh aspect of the present invention, the first determination part may determine the print mode when the printer is powered on.

Advantageous Effects

The present invention can prevent erroneous determination of print modes.

DETAILED DESCRIPTION

Figure 1A:
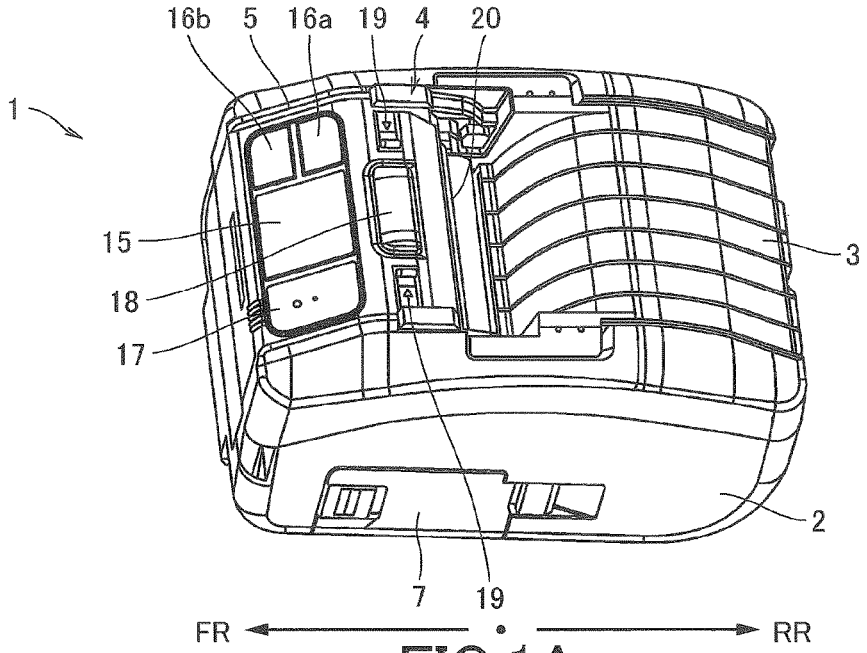
FIG. 1A is an overall perspective view of a printer of the present embodiment in operation of a continuous-print mode.

The present invention relates to Japanese Patent Application No. 2015-016810 filed on Jan. 30, 2015, which is incorporated herein by reference in its entirety. Hereinafter, one embodiment of the present invention will be described in detail with reference to the accompanying drawings. Note that an identical component is, in principle, designated by an identical symbol in the drawings used to describe the present embodiment, and duplicated description thereof is omitted.

1. Overall Configuration of Printer

Figure 1B:
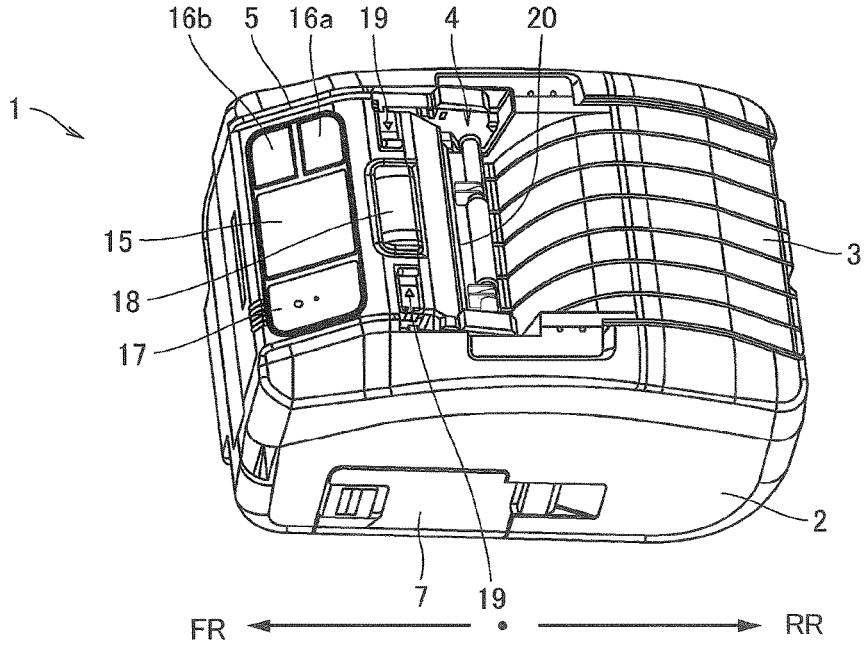
FIG. 1B is an overall perspective view of the printer of the present embodiment in operation of a separation print mode.
Figure 2:
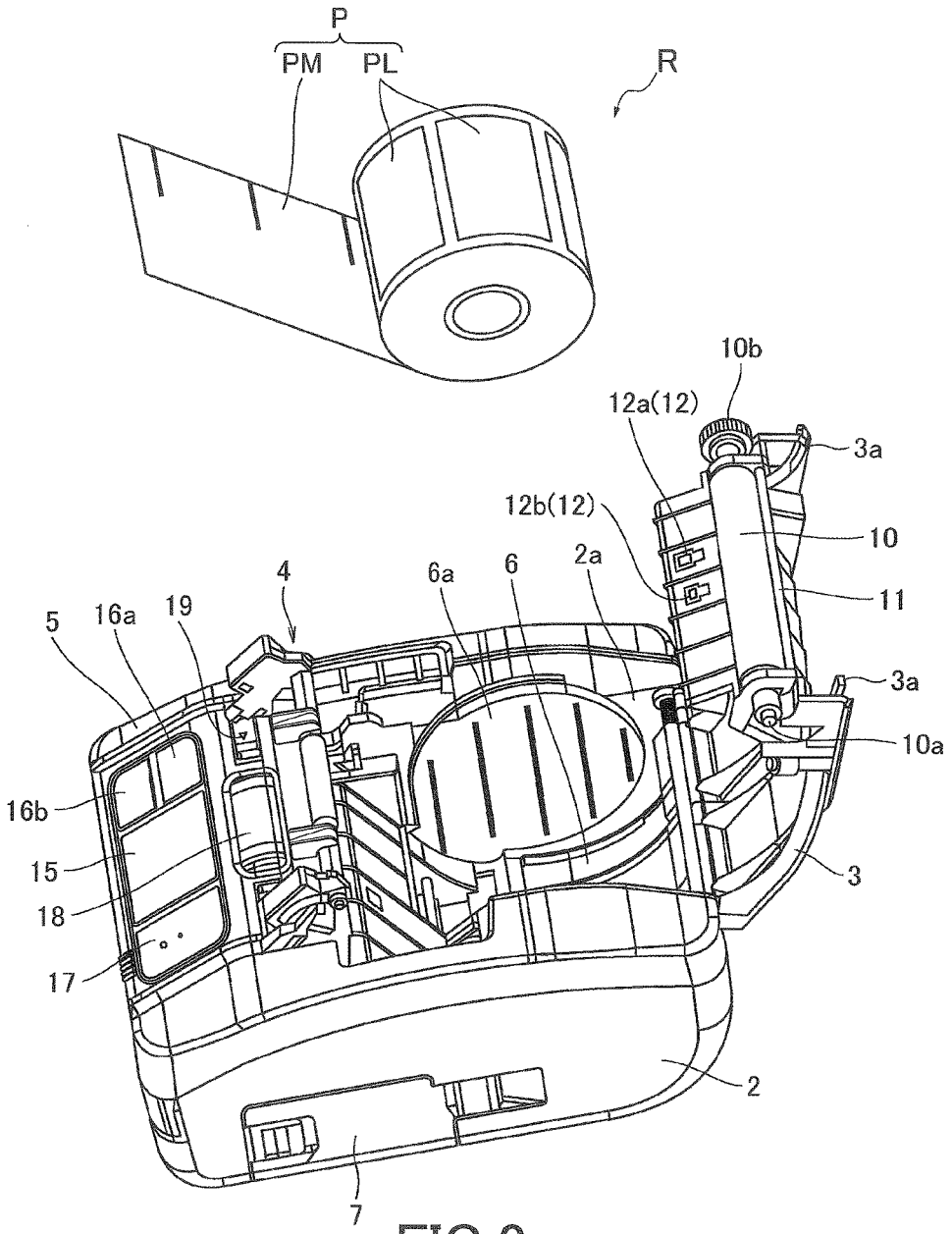
FIG. 2 is an overall perspective view showing the printer of FIGS. 1A and 1B when the open/close cover opens, and an appearance of a roll sheet.
Figure 3:
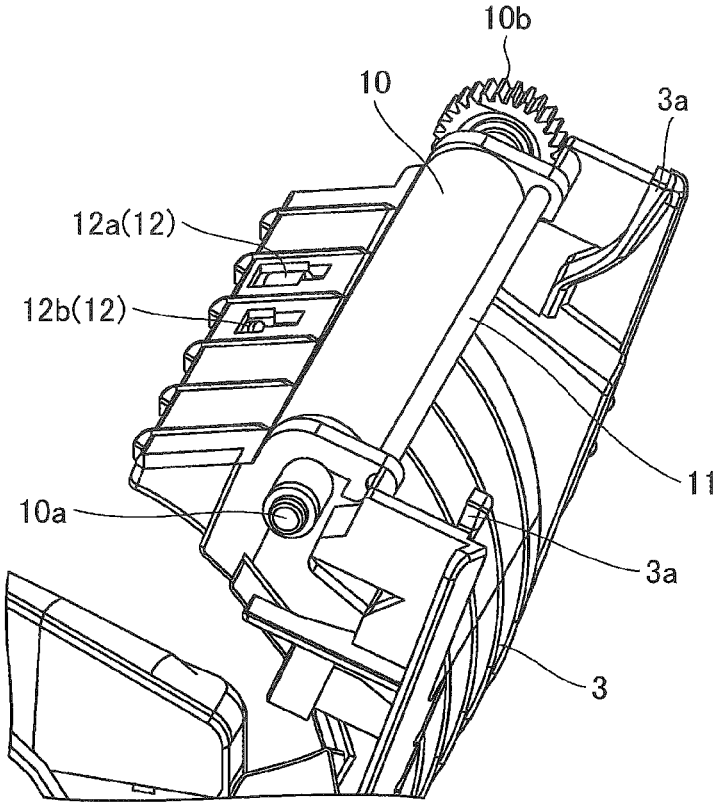
FIG. 3 is a perspective view of main parts of the open/close cover of the printer of FIGS. 1A and 1B.

An overall configuration of the printer will be described. FIG. 1A is an overall perspective view of the printer of the present embodiment in operation of a continuous-print mode. FIG. 1B is an overall perspective view of the printer of the present embodiment in operation of a separation print mode. FIG. 2 is an overall perspective view showing the printer of FIGS. 1A and 1B when the open/close cover opens, and an appearance of a roll sheet. FIG. 3 is a perspective view of main parts of the open/close cover of the printer of FIGS. 1A and 1B. Hereinafter, the longitudinal direction of a printer 1 is referred to as a "frontward and rearward direction"; a direction in which a display part 15 (described later) is disposed is referred to as a "frontward direction (FR)"; and a direction which is opposite to the frontward direction (FR) is referred to as a "rearward direction (RR)." In addition, the sectional views herein show sections of the printer 1 along a plane orthogonal to a flat surface (on which the printer 1 is placed) and extending in the frontward and rearward direction.

As shown in FIGS. 1A and 1B, the printer 1 of the present embodiment is, for example, a portable label printer formed in a thin cuboid. The printer 1 includes a main-body case 2, an open/close cover 3, a separation unit 4, and a front cover 5. The printer 1 can operate in both continuous-print mode (one example of a first print mode) and separation print mode (one example of a second print mode). The printer 1 can be used in any of the following use styles: a style in which an ejection port between the open/close cover 3 and the front cover 5 faces upward (i.e. style in which the printer 1 is laid), a style in which a belt hook (not shown) on the bottom of the printer 1 is hooked on a worker's belt, and a style in which a shoulder belt (not shown) for the printer 1 is slung on a worker's shoulder (i.e. style in which the ejection port faces sideward and the printer 1 is kept vertically).

As shown in FIGS. 1A and 1B, the main-body case 2 defines one part of the external form of the printer 1. As shown in FIG. 2, the main-body case 2 has an opening 2*a* on one surface thereof. Inside of the opening 2*a*, a container 6 is disposed.

The container 6 is a space to house a roll sheet R. The container 6 includes sheet guides 6*a*.

The sheet guides 6*a* are in contact with both ends of the roll sheet R and support the roll sheet R so that the roll sheet R can rotate. Thus, the sheet guides 6*a* is configured to guide a continuous label P extracted from the roll sheet R. The sheet guides 6*a* can move along a width direction of the roll sheet R. With the movement along the width direction of the roll sheet R, the sheet guides 6*a* can guide the roll sheet R having a given width.

As shown in FIG. 2, the roll sheet R is band-like continuous label P wound into a roll. The continuous label P includes a liner PM and a plurality of labels PL (one example of a print medium) temporarily adhering to the liner PM with predetermined intervals.

One side (hereinafter referred to as a "temporarily-adhered side") of both sides of the liner PM, to which the labels are temporarily adhering, is coated with a separation agent (such as silicone) so that the labels PL can be easily separated from the liner PM. The other side (hereinafter referred to as a "back side") of both sides of the liner PM, which is opposite to the temporarily-adhered side, includes position detection marks M with predetermined intervals. The position detection marks M indicate reference positions of the labels PL.

One side (hereinafter referred to as an "adhered side") of both sides of the label PL, which contacts the temporarily-adhered side of the liner PM, is coated with an adhesive agent. With this adhesive agent, the label PL is temporarily adhering to the liner PM. On the other side (hereinafter referred to as a "print side") of both sides of the label PL, which is opposite to the adhered side, a heat-sensitive color development layer is formed. This heat-sensitive color development layer develops a certain color when the temperature of the heat-sensitive color development layer reaches a given temperature region. This color development characteristic allows information to be printed on the print side of the label PL.

As shown in FIGS. 1A to 2, a battery cover 7 is disposed on one side of the main-body case 2. This battery cover 7 can be opened and closed.

As shown in FIG. 2, the open/close cover 3 is configured to open or close the container 6. The rear edge of the open/close cover 3 is pivotally supported on the rear end of the main-body case 2 via a hinge. This allows the front edge of the open/close cover 3 to pivot toward a direction in which the front edge moves closer to the main-body case 2, or a direction in which the front edge moves away from the main-body case 2. In addition, the open/close cover 3 is biased by a torsion spring (not shown) disposed at the rear edge of the open/close cover 3, toward an opening direction (i.e. direction in which the front edge of the open/close cover 3 moves away from the main-body case 2).

As shown in FIGS. 2 and 3, a pair of unit retaining parts 3*a* is disposed at the front end of the open/close cover 3. The pair of unit retaining parts 3*a* is configured to retain the separation unit 4 at a separation print position (described later) when the open/close cover 3 is closed in the separation print mode. The pair of unit retaining parts 3*a* is located at both ends of the open/close cover 3 in a width direction of the open/close cover 3.

On the front end of the open/close cover 3, a platen roller 10 (one example of a first roller) is disposed. The platen roller 10 is configured to feed the continuous label P extracted from the roll sheet R. The platen roller 10 is rotatably supported by a platen shaft 10*a*. The platen roller 10 can rotate in a forward or a reverse direction, and extends along the width direction of the continuous label P. One end of the platen shaft 10*a* is coupled with a gear 10*b*. The gear 10*b* is engaged with another gear (not shown) disposed inside of the opening 2*a* when the open/close cover 3 is closed, and is mechanically connected, via this other gear, to a stepping motor (not shown) for driving the roller.

The open/close cover 3 also includes a separation pin 11 near the platen roller 10. The separation pin 11 is configured to separate the label PL from the liner PM. Both ends of the separation pin 11 are rotatably supported on the open/close cover 3, along the platen roller 10.

On a portion of the open/close cover 3 near the platen roller 10 (more specifically, on a surface of the open/close cover 3 which is adjacent to a sheet-feeding path when the open/close cover 3 is closed), position detection sensors 12*a* and 12*b* are disposed. The position detection sensor 12*a* is configured to detect the position detection marks M (i.e. reference positions of the labels PL) formed on the back side of the liner PM. The position detection sensor 12*a* is a reflective optical sensor. The position detection sensor 12*b* is configured to detect, among the temporarily-adhered side of the liner PM, a portion to which the label PL is temporarily adhering, and a portion to which the label PL is not temporarily adhering. The position detection sensor 12*b* is a thru-beam optical sensor.

The separation unit 4 is configured to separate the label PL, on which information is printed, from the liner PM in the separation print mode. The separation unit 4 can move between a continuous-print position (described later) and the separation print position.

As shown in FIGS. 1A to 2, the front cover 5 is disposed on the upper side of the printer 1. The front cover 5 covers an area of the upper side of the printer 1 other than the area which the open/close cover 3 occupies. The front cover 5 includes a display part 15, operation buttons 16*a* and 16*b* (hereinafter referred collectively to as "operation button 16"), a power button 17, an open button 18, a pair of levers 19, and a cutter 20.

The display part 15 is configured to display a variety of information (such as operation commands and messages). The display part 15 is, for example, a liquid crystal display (LCD).

The operation button 16 is used by a user to give instructions to the printer 1.

The power button 17 is used by a user to turn on or off the power of the printer 1.

The open button 18 is used by a user to open the open/close cover 3.

The pair of levers 19 is configured to hold the separation unit 4 at the continuous-print position. When a user moves the pair of levers 19 in a direction in which the levers 19 approach to each other, the holding of the separation unit 4 is cancelled. When the holding of the separation unit 4 is cancelled, the separation unit 4 moves toward the rear direction (RR) by biasing force of a spring (not shown). When a user then closes the open/close cover 3, the separation unit 4 is retained at the separation print position by the pair of unit retaining parts 3*a*. This changes the position of the separation unit 4 from a position shown in FIG. 1A (continuous-print position) to a position shown in FIG. 1B (separation print position).

The cutter 20 is configured to cut a portion of the liner PM, to which information-printed label PL is temporarily adhering. The cutter 20 is disposed on an end of the front cover 5 and on a side adjacent to the open/close cover 3, and extends along the width direction of the continuous label P.

2. Internal Configuration of Printer

Figure 4A:
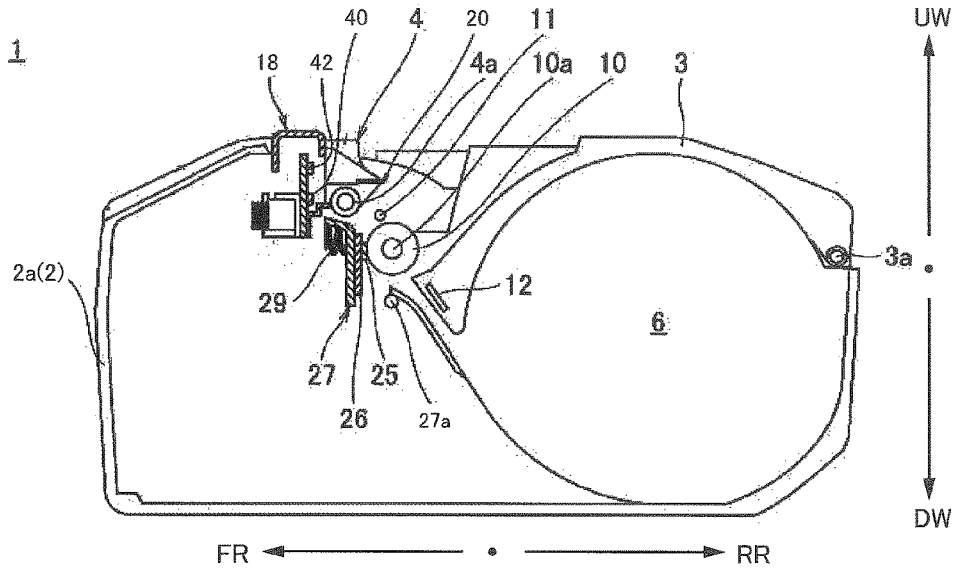
FIG. 4A is a schematic configuration diagram of the printer of FIGS. 1A and 1B in operation of the continuous-print mode, in a section of the printer at a middle position in a width direction.
Figure 4B:
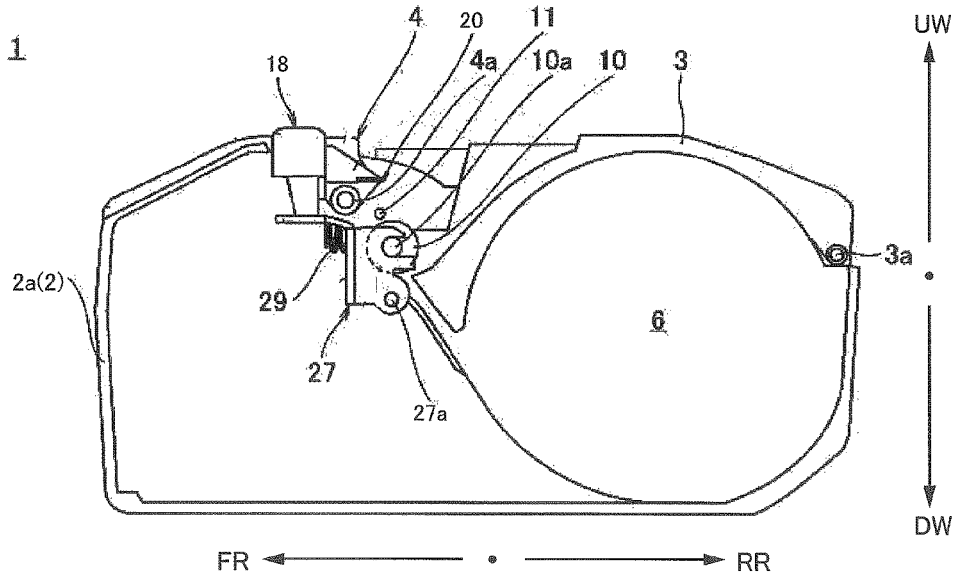
FIG. 4B is a schematic configuration diagram of the printer of FIGS. 1A and 1B in operation of the continuous-print mode, in a section of the printer at a one-end position in the width direction.
Figure 5A:
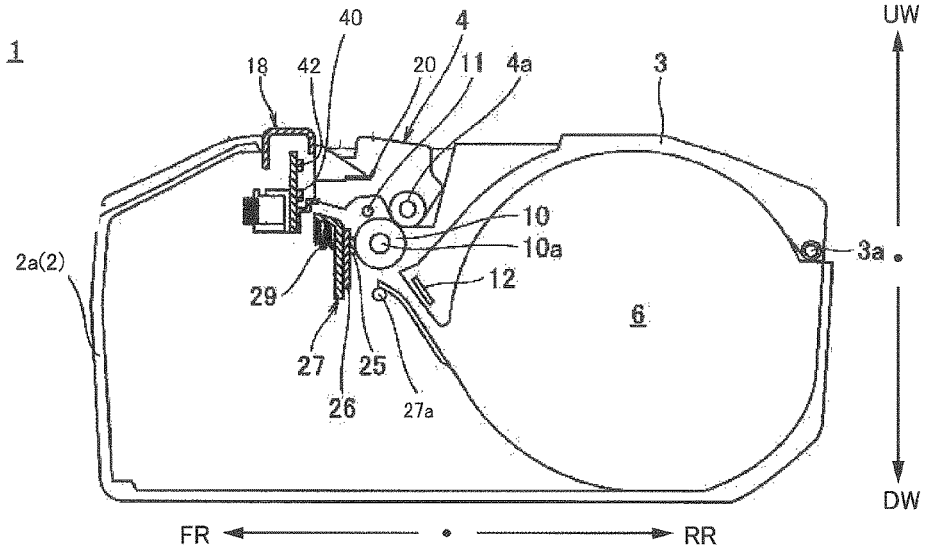
FIG. 5A is a schematic configuration diagram of the printer of FIGS. 1A and 1B in operation of the separation print mode, in a section of the printer at a middle position in the width direction.
Figure 5B:
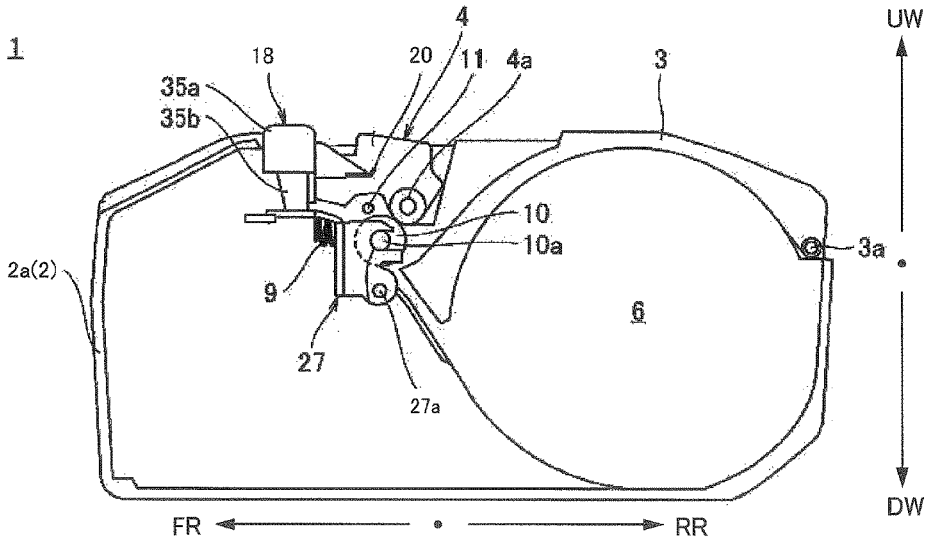
FIG. 5B is a schematic configuration diagram of the printer of FIGS. 1A and 1B in operation of the separation print mode, in a section of the printer at a one-end position in the width direction.
Figure 6:
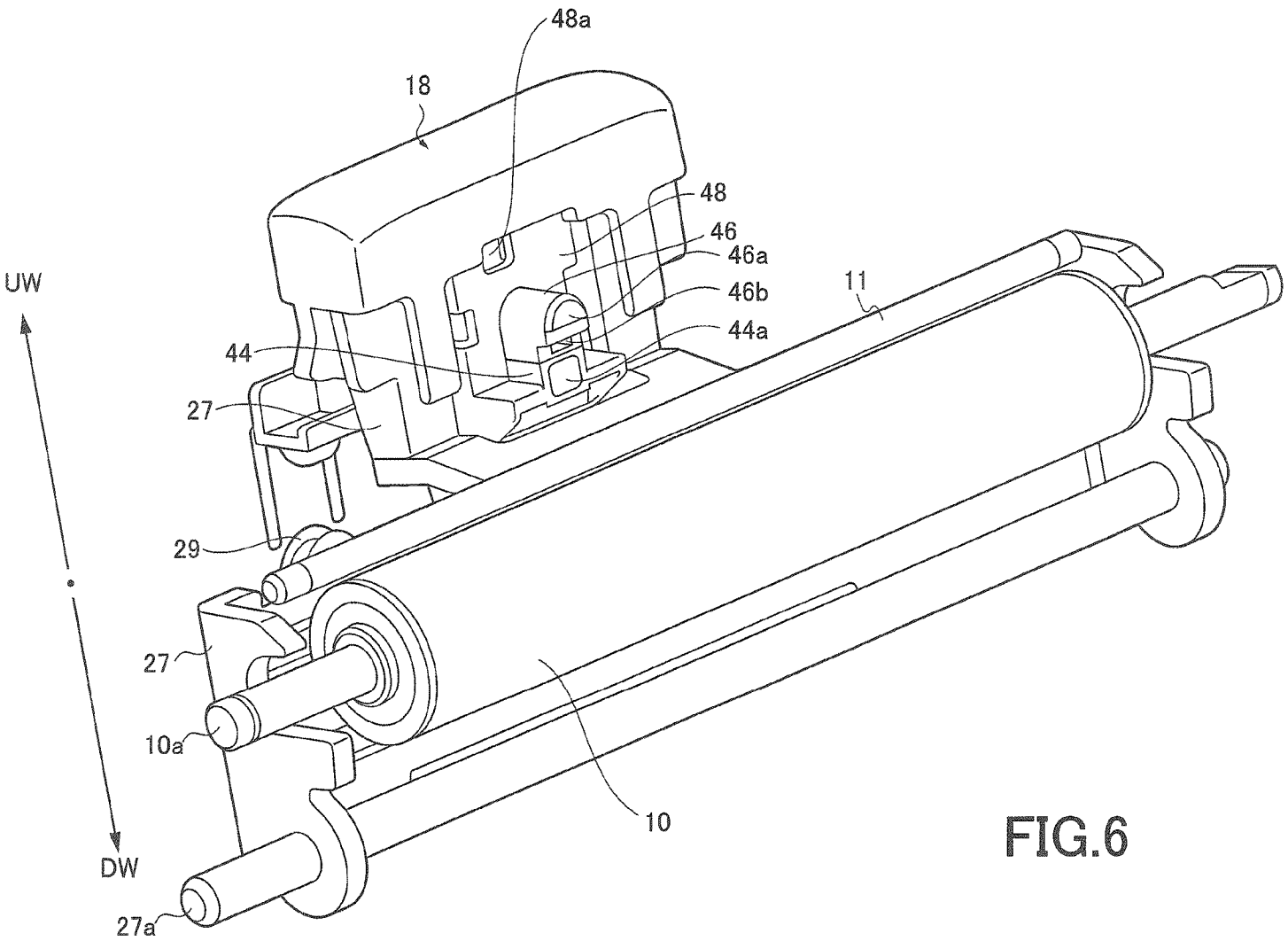
FIG. 6 is a perspective view of main parts disposed around a head bracket of FIGS. 4A and 4B.

An internal configuration of the printer will be described. FIG. 4A is a schematic configuration diagram of the printer of FIGS. 1A and 1B in operation of the continuous-print mode, in a section of the printer at a middle position in a width direction. FIG. 4B is a schematic configuration diagram of the printer of FIGS. 1A and 1B in operation of the continuous-print mode, in a section of the printer at a one-end position in the width direction. FIG. 5A is a schematic configuration diagram of the printer of FIGS. 1A and 1B in operation of the separation print mode, in a section of the printer at a middle position in the width direction. FIG. 5B is a schematic configuration diagram of the printer of FIGS. 1A and 1B in operation of the separation print mode, in a section of the printer at a one-end position in the width direction. FIG. 6 is a perspective view of main parts disposed around a head bracket of FIGS. 4A and 4B. As shown in FIGS. 4A to 6, a direction along a gravitationally downward direction defined when the printer 1 is placed on a horizontal surface is hereinafter referred to as an "upward and downward direction"; the gravitationally downward direction is referred to as a "downward direction (DW)"; and a direction opposite to the downward direction (DW) is referred to as an "upward direction (UW)."

As shown in FIGS. 4A to 5B, the printer 1 includes a separation roller 4*a* (one example of a second roller), the open button 18, the cutter 20, a thermal head 25 (one example of a print unit), a wiring board 26, a head bracket 27, a coil spring 29, a first optical sensor 40 (one example of a reflective optical sensor configured to determine the position of the second roller), and a second optical sensor 42.

The separation roller 4*a* is one component of the separation unit 4. For example, a surface of the separation roller 4*a* is painted with a light-absorbing color (e.g. black). The separation roller 4*a* can be located at two positions. In the continuous-print mode, as shown in FIGS. 4A and 4B, the separation roller 4*a* is located at a continuous-print position (one example of a first position). The continuous-print position is frontward (FR) with respect to the position of the separation pin 11 in the frontward and rearward direction, and upward (UW) with respect to the position of the thermal head 25 in the upward and downward direction. In the separation print mode, as shown in FIGS. 5A and 5B, the separation roller 4*a* is located at a separation print position (one example of a second position). The separation print position is rearward (RR) with respect to the position of the separation pin 11 in the frontward and rearward direction, and upward (UW) with respect to the position of the thermal head 25 in the upward and downward direction. In the separation print position, the separation roller 4*a* rotates by the rotation of the platen roller 10 while the liner PM is nipped between the separation roller 4*a* and the platen roller 10.

The first optical sensor 40 is a reflective optical sensor. The first optical sensor 40 is configured to detect light used to determine a print mode (continuous-print mode or separation print mode), and to detect light used to determine whether there is a label PL separated from the liner PM in the separation print mode. The first optical sensor 40 is located upward (UW) with respect to the thermal head 25 in the upward and downward direction.

The second optical sensor 42 is a reflective optical sensor. The second optical sensor 42 is configured to produce a signal which is necessary to determine whether there is a label PL on which information is printed in the continuous-print mode. The second optical sensor 42 is located upward (UW) with respect to the first optical sensor 40 in the upward and downward direction.

The thermal head 25 is configured to print information (for example, letter, symbol, figure, barcode, or combination thereof) on the label PL. The printed information corresponds to print data sent to the printer 1. The thermal head 25 is attached to the head bracket 27 via the wiring board 26. A print side of the thermal head 25 is adjacent to the platen roller 10 (that is, the print side faces rearward (RR)) when the open/close cover 3 is closed.

The wiring board 26 is configured to transmit a control signal produced by a controller (described later) to the thermal head 25. The wiring board 26 is attached on a rearward (RR) surface of the head bracket 27, and is electrically connected to the thermal head 25.

The head bracket 27 holds the thermal head 25 via the wiring board 26, and holds the open/close cover 3. The head bracket 27 is configured to dissipate heat produced by the thermal head 25. As shown in FIGS. 4A to 6, the head bracket 27 is pivotally supported on a support shaft 27*a* located rearward (RR) with respect to the position of the head bracket 27. The head bracket 27 can swing about the support shaft 27*a* in a direction in which the head bracket 27 moves closer to the platen roller 10, or a direction in which the head bracket 27 moves away from the platen roller 10.

The coil spring 29 is configured to apply a biasing force to the thermal head 25 via the head bracket 27, toward the rearward (RR) direction (i.e. direction from the head bracket 27 to the platen roller 10). This biasing force presses the thermal head 25 against the continuous label P fed by the platen roller 10. This allows clear information to be printed on the label PL.

As shown in FIG. 6, a first sensor housing 44, a second sensor housing 46, and a third sensor housing 48 are disposed on the head bracket 27.

The first sensor housing 44 houses a light emitting part (not shown) of the first optical sensor 40. The first sensor housing 44 has an opening 44*a* in a surface of the first sensor housing 44. The surface is located rearward (RR) with respect to the light emitting part of the first optical sensor 40 (that is, the surface is adjacent to the light emitting part). The light from the light emitting part of the first optical sensor 40 is emitted to the outside of the first sensor housing 44 through the opening 44*a*.

The second sensor housing 46 houses a light receiving part (not shown) of the first optical sensor 40. The second sensor housing 46 has a light blocking part 46*a* and an opening 46*b* in a surface of the second sensor housing 46. The surface is located rearward (RR) with respect to the light receiving part of the first optical sensor 40 (that is, the surface is adjacent to the light receiving part). The light blocking part 46*a* is located at a portion of the rearward (RR) surface of the second sensor housing 46. The portion is located opposite to another portion of the rearward (RR) surface of the second sensor housing 46 on the light emitting part (of the first optical sensor 40) side (that is, the light blocking part 46*a* is located upward). The opening 46*b* is located at the other portion of the rearward (RR) surface of the second sensor housing 46 on the light emitting part (of the first optical sensor 40) side (that is, the opening 46*b* is located downward (DW)). That is, the second sensor housing 46 blocks light incident to one portion of the rearward (RR) surface that is rearward with respect to the light receiving part of the first optical sensor 40. Thus, the light receiving part of the first optical sensor 40 receives light entering the second sensor housing 46 through the opening 46*b*.

The third sensor housing 48 houses the second optical sensor 42. The third sensor housing 48 has an opening 48*a* in a surface of the third sensor housing 48. The surface is located rearward (RR) with respect to a light emitting part (not shown) of the second optical sensor 42 (that is, the surface is adjacent to the light emitting part). The light from the light emitting part of the second optical sensor 42 is emitted to the outside of the third sensor housing 48 through the opening 48*a*.

3. Print Modes

Figure 7:
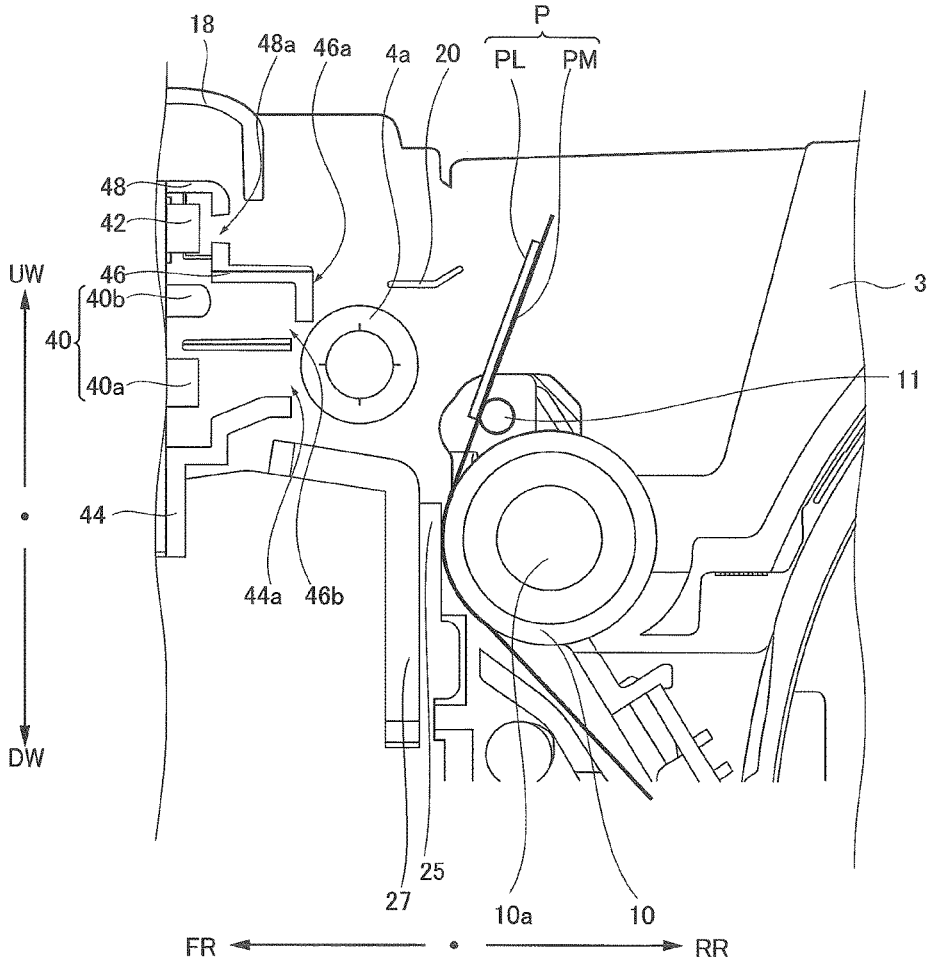
FIG. 7 is a sectional view of main parts of the printer, shown in FIGS. 1A and 1B, in operation of the continuous-print mode.
Figure 8:
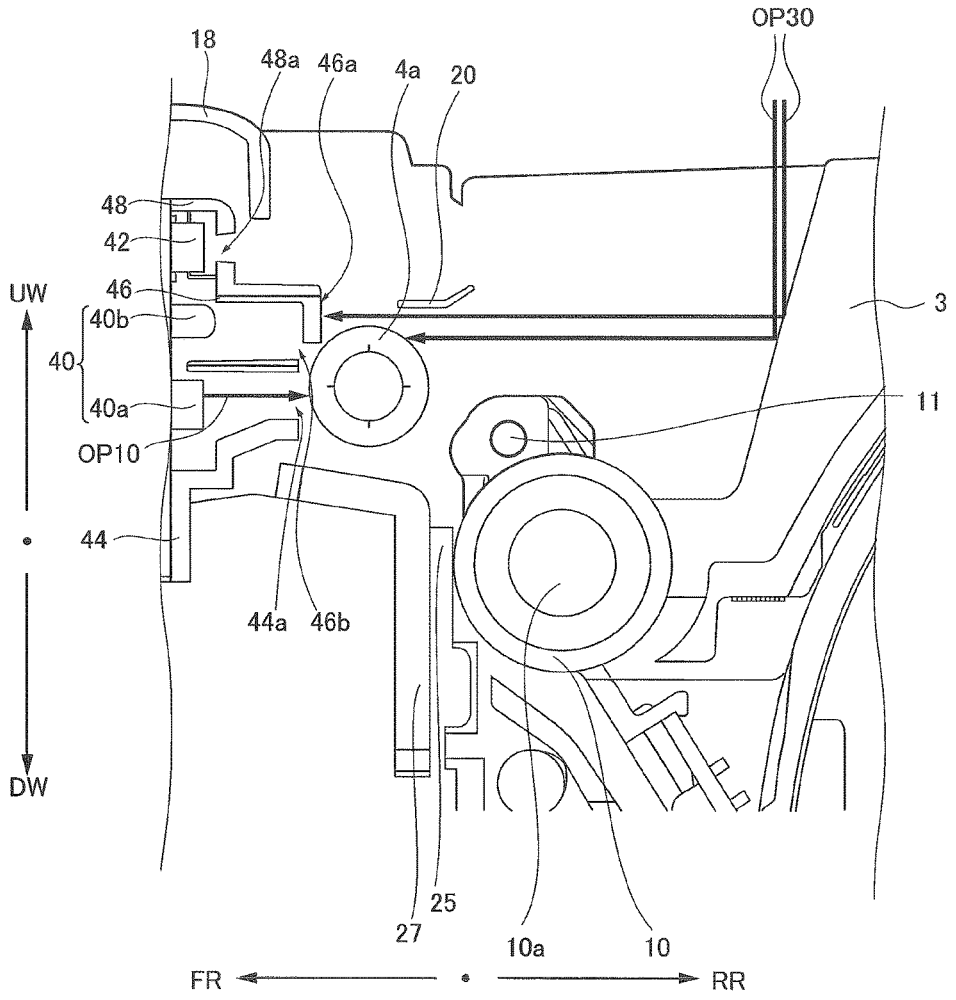
FIG. 8 is a sectional view of the main parts of the printer, shown in FIGS. 1A and 1B, in operation of the continuous-print mode.
Figure 9:
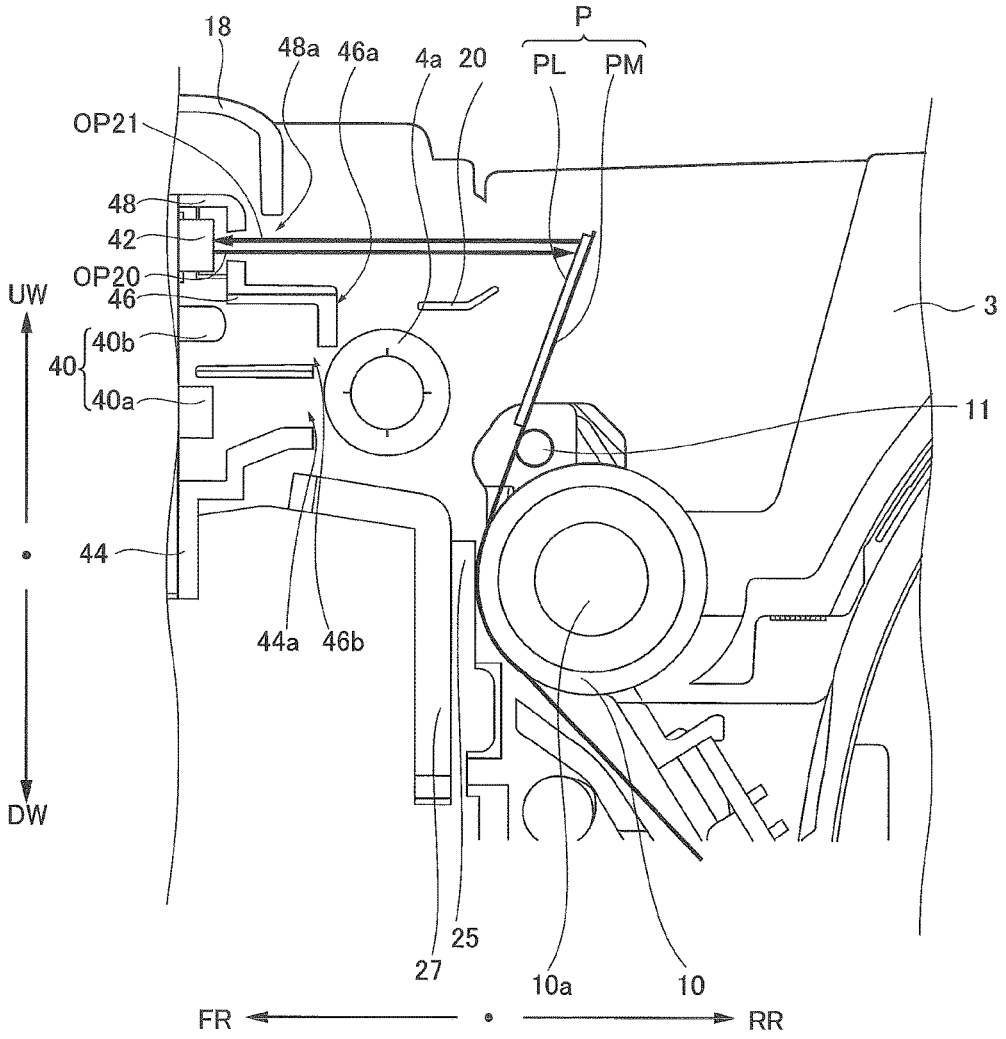
FIG. 9 is a sectional view of the main parts of the printer, shown in FIGS. 1A and 1B, in operation of the continuous-print mode.
Figure 10:
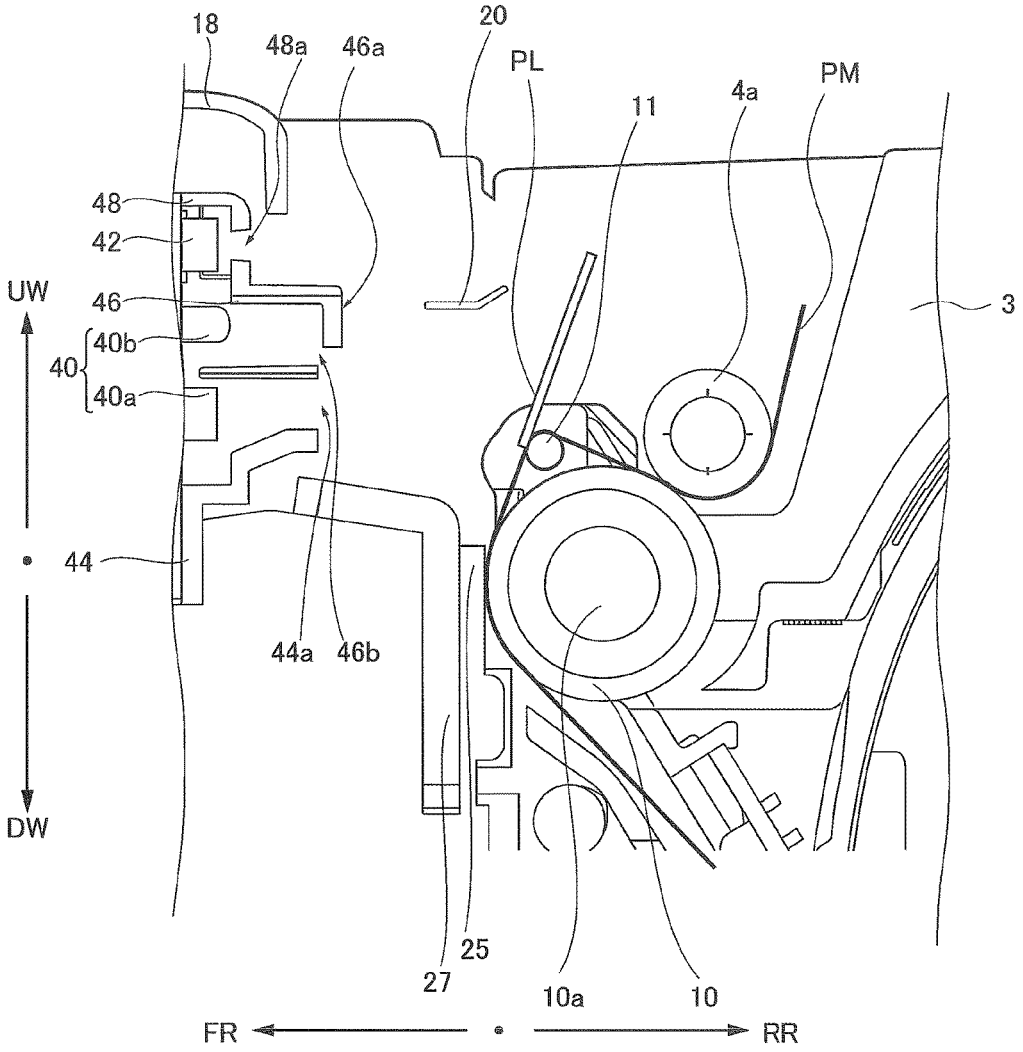
FIG. 10 is a sectional view of the main parts of the printer, shown in FIGS. 1A and 1B, in operation of the separation print mode.
Figure 11:
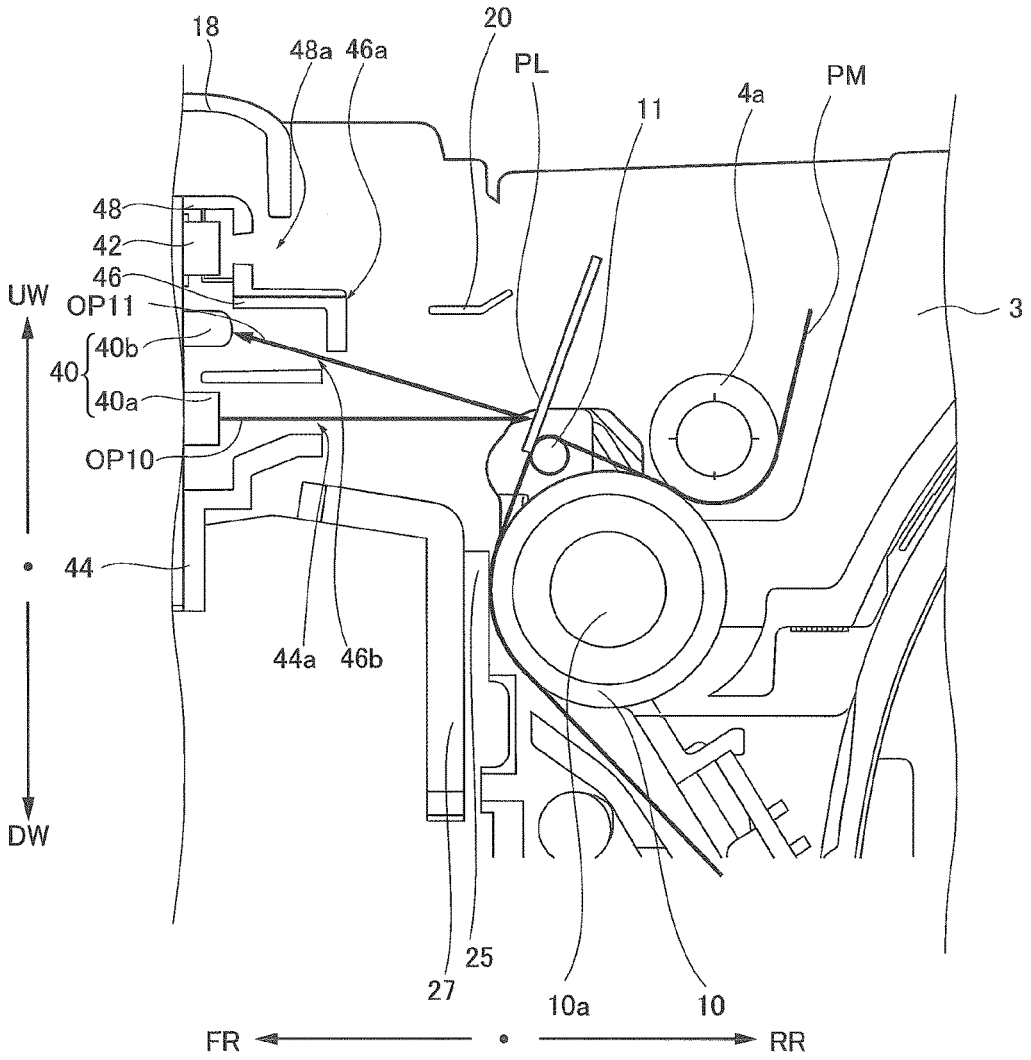
FIG. 11 is a sectional view of the main parts of the printer, shown in FIGS. 1A and 1B, in operation of the separation print mode.
Figure 12:
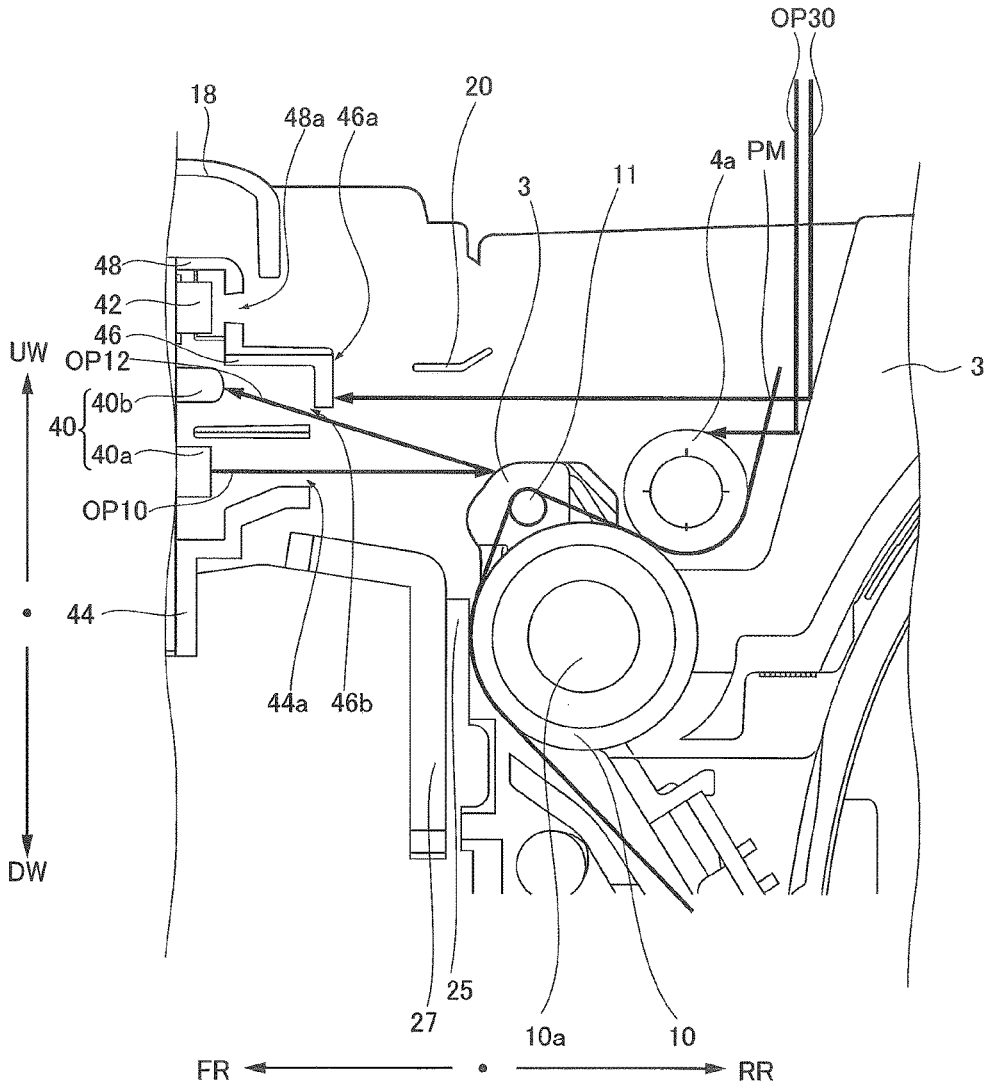
FIG. 12 is a sectional view of the main parts of the printer, shown in FIGS. 1A and 1B, in operation of the separation print mode.

Print modes of the printer of the present embodiment will be described. FIGS. 7 to 9 are sectional views of main parts of the printer, shown in FIGS. 1A and 1B, in operation of the continuous-print mode. FIGS. 10 to 12 are sectional views of the main parts of the printer, shown in FIGS. 1A and 1B, in operation of the separation print mode. Hereinafter, a container 6 side of the sheet-feeding path (i.e. downward (DW) side of FIGS. 7 to 12) is referred to as an "upstream side", and an ejection port side of the sheet-feeding path (i.e. upward (UW) side of FIGS. 7 to 12) is referred to as a "downstream side."

As shown in FIGS. 7 to 12, the light receiving part 40*b* of the first optical sensor 40 is located upward with respect to the light emitting part 40*a* of the first optical sensor 40 in the upward and downward direction. That is, the light receiving part 40*b* is located on the downstream side of the sheet-feeding path with respect to the position of the light emitting part 40*a*.

The second optical sensor 42 is located upward with respect to the first optical sensor 40 in the upward and downward direction. That is, the second optical sensor 42 is located on the downstream side of the sheet-feeding path with respect to the position of the first optical sensor 40 in the upward and downward direction.

The light emitting part 40*a* and the light receiving part 40*b* are partitioned from each other by the first sensor housing 44 and the second sensor housing 46. The light receiving part 40*b* and the second optical sensor 42 are partitioned from each other by the second sensor housing 46 and the third sensor housing 48.

3.1 Operation of Printer in Continuous-Print Mode

The operation of the printer 1 in the continuous-print mode will be described.

As shown in FIG. 7, the separation roller 4*a* is located at the continuous-print position in the continuous-print mode. The continuous-print position is frontward (FR) with respect to the position of the separation pin 11 in the frontward and rearward direction, and upward (UW) with respect to the position of the thermal head 25 in the upward and downward direction.

When the platen roller 10 rotates, the continuous label P is fed along the sheet-feeding path. When the heated thermal head 25 is pressed against a label PL which is temporarily adhering to the liner PM, information based on print data is printed on the label PL. On the downstream side of the sheet-feeding path with respect to the position of the thermal head 25, the back side of the liner PM is supported on the separation pin 11. On the downstream side of the sheet-feeding path with respect to the separation pin 11, the label PL on which information is printed is fed while being temporarily adhering to the liner PM. In the continuous-print mode, information is printed on a predetermined number of labels PL, and then the feeding of the continuous label P stops. The information-printed labels PL are then fed to the ejection port while being temporarily adhering to the liner PM. Thus, a user can cut a portion of the liner PM, to which the predetermined number of information-printed labels are temporarily adhering, with the cutter 20 to take it out of the printer 1.

As shown in FIG. 8, in the continuous-print mode, since light OP10 emitted from the light emitting part 40*a* is absorbed by the separation roller 4*a*, the light OP10 does not enter the light receiving part 40*b*. Disturbance light OP30 is reflected by a surface of the open/close cover 3, and directed toward the light receiving part 40*b*. The disturbance light OP30, however, is blocked by the light blocking part 46*a* and the separation roller 4*a*, and thus does not enter the light receiving part 40*b*. Therefore, the intensity of the light received by the light receiving part 40*b* is substantially zero in the continuous-print mode (that is, the light receiving part 40*b* receives almost no light).

As shown in FIG. 9, when there is an information-printed label PL in the continuous-print mode, light OP20 emitted from the second optical sensor 42 is reflected by this information-printed label PL. Reflected light OP21 of the light OP20 enters the second optical sensor 42. Thus, the second optical sensor 42 detects the reflected light OP21.

3.2 Operation of Printer in Separation Print Mode

The operation of the printer 1 in the separation print mode will be described.

As shown in FIG. 10, the separation roller 4*a* is located at the separation print position in the separation print mode. The separation print position is rearward (RR) with respect to the position of the separation pin 11 in the frontward and rearward direction, and upward (UW) with respect to the position of the thermal head 25 in the upward and downward direction.

When the platen roller 10 rotates, the continuous label P is fed along the sheet-feeding path. When the heated thermal head 25 is pressed against a label PL which is temporarily adhering to the liner PM, information based on print data is printed on the label PL. On the downstream side of the sheet-feeding path with respect to the position of the thermal head 25, the back side of the liner PM is supported on the separation pin 11. On the downstream side of the sheet-feeding path with respect to the separation pin 11, the liner PM is fed by the platen roller 10 and the separation roller 4*a* rotating with the platen roller 10 while being nipped between the platen roller 10 and the separation roller 4*a*. In this case, the separation roller 4*a* rotates by the rotation of the platen roller 10 at the separation print position to split a sheet-feeding path of the information-printed labels PL from a sheet-feeding path of the liner PM at the position of the separation pin 11. In other words, the separation roller 4*a* rotates by the rotation of the platen roller 10 at the separation print position to separate the information-printed labels PL from the liner PM at the position of the separation pin 11. In the separation print mode, every time an information-printed label PL is separated from the liner PM (that is, every time information is printed on each single label PL), the feeding of the continuous label P stops. Thus, a label PL separated from the liner PM stays at the position of the separation pin 11. This allows a user to take only the label PL separated from the liner PM (that is, information-printed label PL), out of the printer 1. When the user takes the label PL, separated from the liner PM, the feeding of the continuous label P is restarted. Then, information is printed on a subsequent label PL following the taken out label PL, the subsequent label PL is separated from the liner PM, and the feeding of the continuous label P stops.

As shown in FIG. 11, when there is a label PL separated from the liner PM in the separation print mode, the light OP10 emitted from the light emitting part 40*a* is reflected by the label PL. Reflected light OP11 of this light OP10 enters the light receiving part 40*b* through the opening 46*b*.

As shown in FIG. 12, when there is no label PL separated from the liner PM in the separation print mode, the light OP10 emitted from the light emitting part 40*a* is reflected by one portion of the open/close cover 3, where the separation pin 11 is rotatably supported. Reflected light OP12 of the light OP10 enters the light receiving part 40*b* through the opening 46*b*.

Since the label PL has its flat surface, the reflected light is unlikely to scatter. In contrast, since the open/close cover 3 has its more uneven surface than the label PL, the reflected light is likely to scatter. Therefore, the intensity OL12 of the reflected light OP12 of FIG. 12 is smaller than the intensity OL11 of the reflected light OP11 of FIG. 11 (OL12<OL11). As shown in FIG. 12, the disturbance light OP30 is reflected by a surface of the open/close cover 3, and directed toward the light receiving part 40*b*. The disturbance light OP30, however, is blocked by the light blocking part 46*a* and the separation roller 4*a*, and thus does not enter the light receiving part 40*b*. Therefore, the intensity of the light received by the light receiving part 40*b* where there is no label PL separated from the liner PM in the separation print mode, is smaller than the intensity of the light received by the light receiving part 40*b* where there is a label PL separated from the liner PM.

4. Controller

Figure 13:
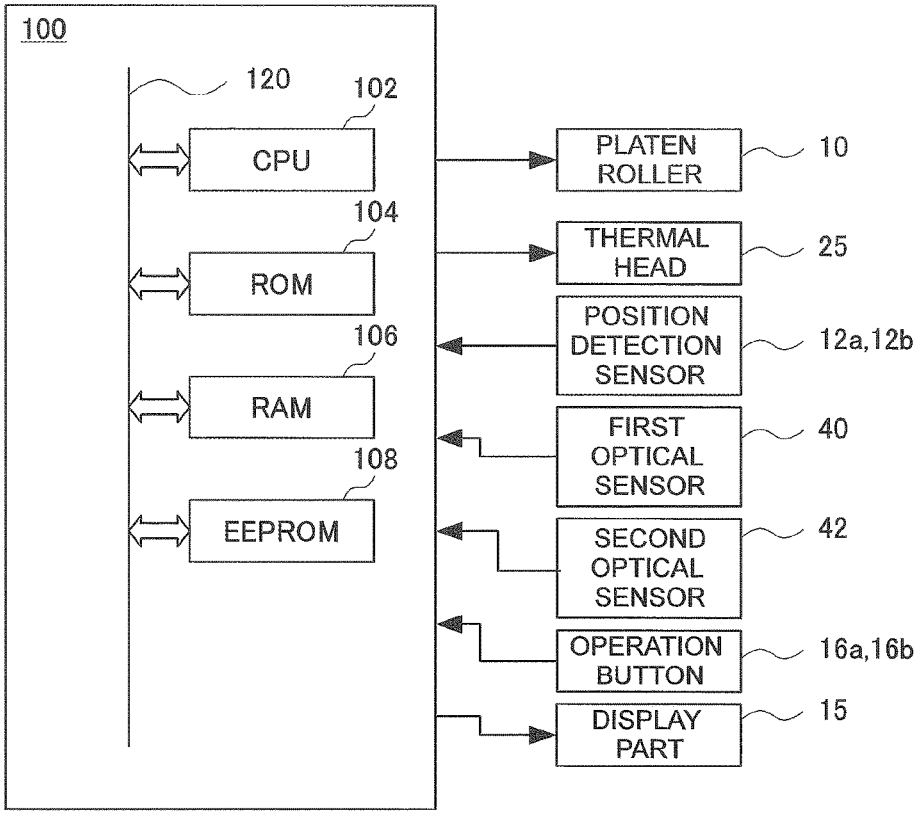
FIG. 13 is a block diagram showing a configuration of a controller of the printer of FIGS. 1A and 1B.

A controller of the printer of the present embodiment will be described. FIG. 13 is a block diagram showing a configuration of the controller of the printer of FIGS. 1A and 1B.

A controller 100 is configured to control the printer 1. As shown in FIG. 13, the controller 100 includes a central processing unit (CPU) 102, a read only memory (ROM) 104, a random access memory (RAM) 106, an electrically erasable programmable read only memory (EEPROM) 108, and a bus 120 for electrically connecting these components to each other.

The RAM 106 stores print data sent from a device (such as a computer) connected to the printer 1.

The EEPROM 108 stores a program with which the CPU 102 executes a function on software (which is hereinafter referred to as "firmware", and is one example of a first determination part and a second determination part) configured to control the printer 1, and also stores control data referred to control the operation of the printer 1.

The control data includes a first threshold TH1 referred to determine a print mode, and a second threshold TH2 referred to determine whether there is a label PL separated from the liner PM in the separation print mode.

The first threshold TH1 is sufficiently smaller than intensity OL12 such that the intensity (substantially zero) of the light received by the light receiving part 40*b* where the separation roller 4*a* is located at the continuous-print position is distinguished from the intensity OL12 of the light OP12 received by the light receiving part 40*b* where the separation roller 4*a* is located at the separation print position and there is no label PL separated from the liner PM.

The second threshold TH2 is between the intensity OL11 and intensity OL12 such that in the separation print mode, the intensity OL11 of the light OP11 received by the light receiving part 40*b* where there is the label PL separated from the liner PM is distinguished from the intensity OL12 of the light OP12 received by the light receiving part 40*b* where there is no label PL separated from the liner PM.

The CPU 102 executes the program stored in the EEPROM 108 to achieve the function of the firmware. The firmware refers to the control data stored in the EEPROM 108 to control the printer 1. Hereinafter, the function of the firmware will be described.

The firmware is configured to determine the reference positions of the labels PL, based on the light detected by the position detection sensors 12*a* and 12*b*.

The firmware is also configured to control the stepping motor for driving the roller. Specifically, the firmware produces a control signal to control the stepping motor for driving the roller when the reference position of a label PL is detected. The platen roller 10 rotates in accordance with this control signal. This allows the continuous label P extracted from the container 6 to be fed along the sheet-feeding path.

The firmware is also configured to control the thermal head 25. The firmware produces a control signal to control the thermal head 25, based on print data stored in the RAM 106. The thermal head 25 is heated in accordance with this control signal. When the heated thermal head 25 is pressed against a label PL which is temporarily adhering to the liner PM fed by the platen roller 10, information corresponding to the print data is printed on the label PL.

The firmware is also configured to determine a print mode, based on the intensity of the light detected by the first optical sensor 40. The firmware is also configured to determine whether there is the label PL separated from the liner PM in the separation print mode.

The firmware is also configured to determine whether there is the information-printed label PL in the continuous-print mode, based on the intensity of the light detected by the second optical sensor 42.

4.1 Function to Determine a Print Mode

The function to determine a print mode will be described.

The firmware compare the intensity OL of the light received by the light receiving part 40*b* with the first threshold TH1 stored in the EEPROM 108 to determine a print mode.

If the intensity OL of the light received by the light receiving part 40*b* is less than the first threshold TH1 (OL<TH1), then the firmware determines that the print mode is the continuous-print mode. For example, as shown in FIG. 8, when the separation roller 4*a* is located at the continuous-print position, the intensity OL of the light received by the light receiving part 40*b* is substantially zero (OL<TH1). Thus, the firmware determines that the print mode is the continuous-print mode.

If the intensity OL of the light received by the light receiving part 40*b* is equal to or larger than the first threshold TH1 (OL≥TH1), then the firmware determines that the print mode is the separation print mode. For example, as shown in FIGS. 11 and 12, when the separation roller 4*a* is located at the separation print position, the intensities OL11 and OL12 of the light received by the light receiving part 40*b* are both larger than the first threshold TH1. Thus, the firmware determines that the print mode is the separation print mode.

4.2 Function to Determine Whether there is a Label PL Separated from the Liner PM in the Separation Print Mode The function to determine whether there is a label PL separated from the liner PM in the separation print mode will be described.

The firmware compare the intensity OL of the light received by the light receiving part 40*b* with the second threshold TH2 stored in the EEPROM 108 to determine whether there is a label PL separated from the liner PM in the separation print mode.

If the intensity OL of the light received by the light receiving part 40*b* is equal to or larger than the second threshold TH2 (OL≥TH2), then the firmware determines that there is a label PL separated from the liner PM. For example, as shown in FIG. 11, when there is a label PL separated from the liner PM at the position of the separation pin 11, the intensity OL11 of the light received by the light receiving part 40*b* is equal to or larger than the second threshold TH2 (OL11≥TH2). Thus, the firmware determines that there is a label PL separated from the liner PM. In this case, the firmware causes the platen roller 10 and the thermal head 25 to stop until the label PL separated from the liner PM is removed (that is, until the intensity OL of the light received by the light receiving part 40*b* is less than the second threshold TH2).

If the intensity OL of the light received by the light receiving part 40*b* is less than the second threshold TH2 (OL<TH2), then the firmware determines that there is no label PL separated from the liner PM. For example, as shown in FIG. 12, when there is no label PL separated from the liner PM, the intensity OL12 of the light received by the light receiving part 40*b* is less than the second threshold TH2 (OL12<TH2). Thus, the firmware determines that there is no label PL separated from the liner PM. In this case, the firmware drives the platen roller 10 and control the thermal head 25 to print information on a subsequent label PL.

5. Summary of the Present Embodiment

The present embodiment will be summarized.

In the present embodiment, the light receiving part 40*b* does not receive the disturbance light OP30, as described above. That is, any light unnecessary to determine a print mode and whether there is a label PL separated from the liner PM in the separation print mode can be prevented from entering the light receiving part 40*b*. This can prevent erroneous determination of print modes.

In particular, in the present embodiment, the light receiving part 40*b* is located upward with respect to the light emitting part 40*a* in the upward and downward direction. In addition, the opening 46*b* is formed at the portion of the rearward (RR) surface of the second sensor housing 46 on the light emitting part (of the first optical sensor 40) side (that is, the opening 46*b* is located downward (DW)). That is, the second sensor housing 46 is open on the downward (DW) side. Thus, the disturbance light 30 is unlikely to enter the second sensor housing 46. This can more effectively prevent erroneous determination of print modes.

In the present embodiment, the function to determine a print mode is activated when the printing of information is enabled. The firmware determines a print mode based on the position of the separation roller 4*a* (i.e. continuous-print position or separation print position). With this, a user has only to set the position of the separation roller 4*a* and then activate the printing of information (for example, operate the power button 17), in order to perform the print operation in a desired print mode.

In the present embodiment, the firmware determines a print mode and whether there is a label PL separated from the liner PM in the separation print mode, based on the intensity of the light received by the light receiving part 40*b*. That is, only the (single) first optical sensor 40 is necessary to determine a print mode and whether there is a label PL separated from the liner PM in the separation print mode. This can reduce the number of sensors of the printer 1 that is operable in either of the two operation modes (continuous-print mode and separation print mode), and thereby make the printer 1 smaller.

6. Modifications

Hereinafter, modifications of the present embodiment will be described.

The above embodiment is described for the case where the light receiving part 40*b* is located upward (UW) with respect to the light emitting part 40*a*, but the scope of the present invention is not limited to this example. The present invention may be applied to the case where the light receiving part 40*b* is located downward (DW) with respect to the light emitting part 40*a*.

In the above-described embodiment, the timing when a print mode is determined may be time when the printing of information is enabled. The time when the printing of information is enabled maybe any one of the followings:

- time when the power of the printer 1 is turned on (for example, time when a user operates the power button 17 where the power of the printer 1 is off); and
- time when the printer 1 is recovered from its sleep state,
  - specifically, time when the printer 1 receives print data, during its sleep state, sent from a computer connected to the printer 1,
  - specifically, time when a user operates the operation button 16 during the sleep state of the printer 1, and
  - specifically, time when the open/close cover 3 is closed during the sleep state of the printer 1.

In the above-described embodiment, it is exemplified that the firmware is configured to determine a print mode with reference to the first threshold TH1, and to determine whether there is the label PL separated from the liner PM with reference to the second threshold TH2. But the determination whether there is the label PL separated from the liner PM with reference to the threshold TH2 may be omitted.

In the above-described embodiment, it is exemplified that the print medium is the continuous label P in which the plurality of labels PL are temporarily adhering to the temporarily-adhered side of the liner PM with predetermined intervals. But the scope of the present invention is not limited to this. The present invention may be applied to the case where the print medium is a non-separated continuous label whose one side is an adhered side (that is, hereinafter referred to as a "linerless label"), a continuous sheet having no adhered side, or any print medium (such as a film) other than the label on which the thermal head may print. The linerless label, the continuous sheet, and the film may include the position detection marks. In the case where the linerless label is fed, the feeding path may be coated with a non-adhesive agent, and the platen roller may contain a non-adhesive material (such as silicone).

The embodiments of the present invention have been described in detail, but the scope of the present invention is not limited to the above-described embodiments. The above-described embodiments may be modified or changed in various ways without departing the spirit of the present invention. In addition, the above-described embodiments and modifications can be combined.

The invention claimed is:

1. A printer configured to perform a print operation in at least one of a first print mode in which information is printed on a print medium temporarily adhering to a liner and then the print medium is not separated from the liner, or a second print mode in which information is printed on the print medium and then the print medium is separated from the liner, the printer comprising:

a first roller configured to feed the liner;

a print unit configured to print information on the print medium temporarily adhering to the liner fed by the first roller;

a second roller located at a first position when the print operation is performed in the first print mode, and located at a second position when the print operation is performed in the second print mode, the second roller that is located at the second position is configured to rotate by rotation of the first roller to separate the print medium from the liner;

a reflective optical sensor including a light emitting part and a light receiving part that are arranged in a direction of a sheet-feeding path, the reflective optical sensor configured to determine a position of the second roller; and a sensor housing configured to house the light receiving part, the sensor housing having a surface adjacent to the light receiving part, the surface having an opening on a side of the light emitting part and a light blocking part on a side opposite to the side of the light emitting part, wherein the second roller blocks the light from entering through the opening when located at the first position, and the second roller unblocks the light from entering through the opening when located at the second position.

2. The printer according to claim 1, wherein the light receiving part is disposed on a downstream side of the sheet-feeding path with respect to the light emitting part.

3. The printer according to claim 1, further comprising a first determination part configured to compare an intensity of light received by the light receiving part with a first threshold to determine a print mode.

4. The printer according to claim 3, wherein the first determination part determines the print mode when printing by the print unit is enabled.

5. The printer according to claim 4, wherein the first determination part determines the print mode when the printer is powered on.

6. The printer according to claim 3, further comprising a second determination part configured to compare, when performing the print operation in the second print mode, intensity of light received by the light receiving part with a second threshold larger than the first threshold to determine whether the print medium is separated from the liner.

7. The printer according to claim 2, further comprising a first determination part configured to compare an intensity of light received by the light receiving part with a first threshold to determine a print mode.

8. A printer configured to perform a print operation in at least one of a first print mode in which information is printed on a print medium temporarily adhering to a liner and then the print medium is not separated from the liner, or a second print mode in which information is printed on the print medium and then the print medium is separated from the liner, the printer comprising:

a first roller configured to feed the liner;

a print unit configured to print information on the print medium temporarily adhering to the liner fed by the first roller;

a second roller located at a first position when the print operation is performed in the first print mode, and located at a second position when the print operation is performed in the second print mode, the second roller that is located at the second position configured to rotate by rotation of the first roller to separate the print medium from the liner; and a reflective optical sensor including a light emitting part and a light receiving part, the reflective optical sensor configured to determine a position of the second roller, wherein the first position is between a sheet-feeding path on which the liner is fed by the first roller and the reflective optical sensor, the second roller blocks the light from entering through an opening to the reflective optical sensor when located at the first position, and the second roller unblocks the light from entering through the opening when located at the second position.

9. The printer according to claim 8, wherein the light receiving part is disposed on a downstream side of the sheet-feeding path with respect to the light emitting part.

10. The printer according to claim 8, further comprising a first determination part configured to compare an intensity of light received by the light receiving part with a first threshold to determine a print mode.

11. The printer according to claim 10, wherein the first determination part determines the print mode when printing by the print unit is enabled.

12. The printer according to claim 10, further comprising a second determination part configured to compare, when performing the print operation in the second print mode, the intensity of light received by the light receiving part with a second threshold larger than the first threshold to determine whether there is the print medium separated from the liner.

13. A printer configured to perform a print operation in at least one of a first print mode in which information is printed on a print medium temporarily adhering to a liner and then the print medium is not separated from the liner, or a second print mode in which information is printed on the print medium and then the print medium is separated from the liner, the printer comprising:

a first roller configured to feed the liner;

a print unit configured to print information on the print medium temporarily adhering to the liner fed by the first roller;

a second roller located at a first position when the print operation is performed in the first print mode, and located at a second position when the print operation is performed in the second print mode, the second roller that is located at the second position configured to rotate by rotation of the first roller to separate the print medium from the liner;

a reflective optical sensor including a light emitting part and a light receiving part, the reflective optical sensor configured to determine a position of the second roller;

a sensor housing configured to house the light receiving part;

a first determination part configured to compare an intensity of light received by the light receiving part with a first threshold to determine the print mode; and a second determination part configured to compare, when performing the print operation in the second print mode, the intensity of light received by the light receiving part with a second threshold larger than the first threshold to determine whether the print medium is separated from the liner, wherein the sensor housing has a surface adjacent to the light receiving part, the surface having an opening on a side of the light emitting part and a light blocking part on a side opposite to the side of the light emitting part, the first position is between a sheet-feeding path on which the liner is fed by the first roller and the opening, the second roller blocks the light from entering through the opening when located at the first position, and the second roller unblocks the light from entering through the opening when located at the second position.

14. The printer according to claim 13, wherein the light receiving part is disposed on a downstream side of the sheet-feeding path with respect to the light emitting part.

15. A printer configured to perform a print operation in at least one of a first print mode in which information is printed on a print medium temporarily adhering to a liner and then the print medium is not separated from the liner, or a second print mode in which information is printed on the print medium and then the print medium is separated from the liner, the printer comprising:

a first roller configured to feed the liner;

a print unit configured to print information on the print medium temporarily adhering to the liner fed by the first roller;

a second roller located at a first position when performing the print operation in the first print mode, and located at a second position when performing the print operation in the second print mode to separate the print medium from the liner;

an optical sensor configured to determine a position of the second roller;

a first determination part configured to compare an intensity of light detected by the optical sensor with a first threshold to determine the print mode; and a second determination part configured to compare the intensity of light detected by the optical sensor with a second threshold larger than the first threshold to determine whether the print medium is separated from the liner in the second print mode, wherein the first position is between a sheet-feeding path on which the liner is fed by the first roller and the optical sensor, the second roller blocks the light emitted toward the optical sensor when located at the first position, and the second roller unblocks the light emitted toward the optical sensor when located at the second position.

16. The printer according to claim 15, wherein the first determination part determines a print mode when printing by the print unit is enabled.

17. The printer according to claim 1, further comprising a separation pin configured to support the liner fed by the first roller, wherein the first position is close to the opening with respect to a position of the separation pin, the second position is at an opposite side of the opening with respect to the position of the separation pin.

18. The printer according to claim 8, further comprising a separation pin configured to support the liner fed by the first roller, wherein the first position is close to the reflective optical sensor with respect to a position of the separation pin, the second position is at an opposite side of the reflective optical sensor with respect to the position of the separation pin.

19. The printer according to claim 13, further comprising a separation pin configured to support the liner fed by the first roller, wherein the first position is close to the opening with respect to a position of the separation pin, the second position is at an opposite side of the opening with respect to the position of the separation pin.

20. The printer according to claim 15, further comprising a separation pin configured to support the liner fed by the first roller, wherein the first position is close to the optical sensor with respect to a position of the separation pin, the second position is at an opposite side of the optical sensor with respect to the position of the separation pin.

21. The printer according to claim 1, wherein in the second print mode, an intensity of light received by the light receiving part when the print medium is not separated from the liner is lower than an intensity of light received by the light receiving part when the print medium is separated from the liner.

* * * * *